US006706151B1

(12) United States Patent
Oosthuizen et al.

(10) Patent No.: US 6,706,151 B1
(45) Date of Patent: Mar. 16, 2004

(54) PULP MOULDING PROCESS AND RELATED SYSTEM

(75) Inventors: Johan Jacob Oosthuizen, Somerset West (ZA); Jonathan David Taljaard, Lyon (ZA)

(73) Assignee: Southern Pulp Machinery (PTY) Limited, Strand (ZA)

( * ) Notice: Subject to any disclaimer, the term of this patent is extended or adjusted under 35 U.S.C. 154(b) by 0 days.

(21) Appl. No.: 09/937,808

(22) PCT Filed: Mar. 24, 2000

(86) PCT No.: PCT/ZA00/00057

§ 371 (c)(1),
(2), (4) Date: Jan. 28, 2002

(87) PCT Pub. No.: WO00/58557

PCT Pub. Date: Oct. 5, 2000

(30) Foreign Application Priority Data

Mar. 26, 1999 (ZA) ..... 99/2351

(51) Int. Cl.[7] ..... D21F 13/00

(52) U.S. Cl. ..... 162/218; 162/382; 162/116; 162/212; 162/214; 162/217; 162/390; 162/407

(58) Field of Search ..... 162/218, 382, 162/116, 212, 214, 217, 390, 388, 407, 408, 409, 226

(56) References Cited

U.S. PATENT DOCUMENTS

| | | | | |
|---|---|---|---|---|
| 2,377,864 A | * | 6/1945 | Chaplin | 92/56 |
| 4,088,259 A | * | 5/1978 | Sutton | 229/2.5 |
| 5,174,863 A | | 12/1992 | Emery | |
| 5,531,864 A | | 7/1996 | Miyamoto et al. | |
| 5,656,135 A | | 8/1997 | Baker | |
| 5,833,805 A | | 11/1998 | Emery | |

FOREIGN PATENT DOCUMENTS

| | | |
|---|---|---|
| EP | 0 055 949 | 7/1982 |
| EP | 0 728 868 | 8/1996 |
| EP | 0 731 214 | 9/1996 |
| GB | 229 550 | 5/1996 |
| WO | WO 92 11414 | 7/1992 |

* cited by examiner

*Primary Examiner*—Peter Chin
*Assistant Examiner*—Mark Halpern
(74) *Attorney, Agent, or Firm*—McDonnell Boehnen Hulbert & Berghoff

(57) ABSTRACT

A pulp moulding process including the steps of pulp stock, forming wet products by means of forming die (7), transferring the wet products from the forming die by means of a heated transferring die-and-heated pressing tool arrangement (13)(14) for in-mould pressing and drying of the wet product, and delivering the dried products to a down line facility (18). The invention encompasses a pulp moulding system, a pulp moulding apparatus, and a pulp moulded product made by such a process, system and/or apparatus.

12 Claims, 7 Drawing Sheets

PULP MOULDING PROCESS AND RELATED SYSTEM

TECHNICAL FIELD

This invention relates to a pulp moulding process. More particularly but not exclusively, the invention relates to a pulp moulding process, a pulp moulding system, specific pulp moulding apparatus and a pulp moulded product made by such a process, system and/or apparatus.

BACKGROUND ART

The process of pulp moulding in which pulp, typically constituted by water and raw materials such as paper, is moulded to produce products such as functional packaging materials is well known. The process traditionally incorporates the steps of pulp stock preparation, wet forming of products with forming dies, transferring of wet products with transfer dies, drying and packing of the final dry products.

Known disadvantages of the traditional pulp moulding process include relatively high capital costs, poor product quality, high energy costs and high space requirements as well as relatively high manpower requirements.

A known improvement of the traditional pulp moulding process is the so-called "in-mould drying" or "thermoformed" process, the process endeavouring to achieve an improved quality comparable with injection moulded, thermoformed plastic products. The in-mould drying process comprises the traditional process, characterized in that it substitutes the step of conveyor drying with an in-mould drying step wherein the wet or so-called "in-mould" dried product is press dried between heated, opposed, closable pressing tools, with steam resulting from the heating being scavenged under vacuum. The incorporation of the in-mould drying step is aimed at improving poor product finish such as surface coarseness as well as dimensional inaccuracies and deformities. The poor product finish is caused primarily during process, where the wet product is subjected to high temperature, high velocity air flow. In a preferred form, the in-mould drying process includes further in-mould drying in down line pressing stations. The added advantage of additional pressing stations is the speeding up of the pressing portion of the pressing and drying process.

A variation of such in-mould drying processes is found in U.S. Pat. No. 4,088,259 in the name of John T Sutton. U.S. Pat. No. 4,088,259 discloses apparatus for moulding an egg carton wherein a pulp egg carton is formed in a forming mould, transferred to a vacuum drying mould, and carried through several subsequent drying and finish-forming stations.

Known disadvantages of the in-mould drying process however include relatively slower cycle times and corresponding lower product output, relatively high down time due to slower mould changing procedures, expensive tooling, an additionally required vacuum system for steam scavenging and relatively larger sized moulders so as to provide for the additional pressing stations and expensive pneumatic and/or hydraulic pressing system.

It is accordingly an object of the invention to provide a pulp moulding process, a pulp moulding system as well as products moulded from such a process and/or system which will overcome or at least reduce the above disadvantages, or at least to provide a novel and/or relatively inexpensive, alternative pulp moulding process.

DISCLOSURE OF INVENTION

According to a first aspect of the invention there is provided a pulp moulding process including the steps of preparing pulp stock; forming wet products by means of a forming die; transferring the wet products from the forming die by means of a heated transferring die-and-heated pressing tool arrangement for in-mould pressing and drying of the wet product; and delivering the dried products to a down line facility.

The process may include the step of using a heated fluid medium for providing heat in the pressing and drying step, the medium being preferably steam.

The process may include the step of using a heated fluid medium for providing heat in the pressing and drying step, the medium being preferably thermal oil. The thermal oil may be maintained at a negative gauge pressure.

The process may include any one or both of the steps of forcing steam generated during the pressing and drying step in one direction through the in-mould wet product; and venting the generated steam to the atmosphere, alternately scavenging the stream under vacuum.

The method may include any one or both of the steps of forcing heated gas, such as air, through the in-mould wet product at high pressure; and venting the steam generated during the in-mould pressing and driving step to the atmosphere, alternatively scavenging the steam under vacuum.

According to a second aspect of the invention there is provided a transfer die-and-heated pressing tool arrangement for use in a pulp moulding process as hereinbefore defined, the transfer die-and-pressing tool arrangement comprising a male part and a female part, at least one part being provided with a primary fluid passage for receiving a heating fluid therethrough and at least one part being provided with at least one vent so as to allow steam generated during an in-mould pressing and drying step to escape therethrough to the atmosphere, alternatively to a vacuum.

The heated transfer die-and-pressing tool arrangement may be characterized in that at least one of the male part and female part may comprise a die element mounted on a plate including a plenum chamber incorporating the primary fluid passage. The heated transfer die-and-pressing tool arrangement may be configured so as to allow the in-mould pressing and drying step to take place with the plate being oriented substantially vertically.

The heated transfer die-and-pressing tool arrangement may be characterized in being provided with at least one secondary fluid passage for receiving pressurized gas, such as air, therethrough, the secondary fluid passage being oriented so as to communicate gaseously with the vent to force the pressurized gas and the steam generated during the in-mould drying step in one direction through the in-mould wet product via the vent directly to the atmosphere, alternatively to a vacuum.

The heated transfer die-and-pressing tool arrangement preferably is provided with a set of secondary fluid passages and a set of vents, the set of secondary fluid passages and the set of vents being staggered relative to each other so as to enhance the substantially uniform flow of pressurized gas through the wet product.

According to a third aspect of the invention there is provided press drying equipment for an in-mould drying, pulp moulding system, the equipment including a heated transfer die and a heated pressing tool, the heated transfer die and the heated pressing tool being operatively associated mechanically with each other so as to provide a heated, mechanical press therebetween in a heated transfer die-and-heated pressing tool arrangement.

The heated transfer die-and-heated pressing tool arrangement may be rotary so as to enable rotary transfer and drying of a wet product between a forming die and a down line facility.

According to a fourth aspect of the invention there is provided a method for in-mould drying of a wet product in a pulp moulding process, the method including the step of passing pre-heated gas, such as air, through an in-mould wet product so as to accelerate the drying of the product.

According to a fifth aspect of the invention there is provided a method of heating a pressing tool in a pulp moulding process, the method including the step of flowing a heating fluid through a fluid passage in a heated pressing tool.

According to a sixth aspect of the invention there is provided an in-mould drying, pulp moulding system comprising means for preparing pulp stock; a wet forming section, incorporating forming dies; and means for transferring wet product from the forming dies and press drying the wet product, the means including a heated transferring die-and-pressing tool arrangement, the arrangement being substantially as hereinbefore defined.

The system may include a down line drying tunnel so as to complete drying, thus enhancing the overall cycle of the system.

According to a seventh aspect of the invention, there is provided a pulp moulded product, manufactured using pulp moulding process including the steps of preparing pulp stock; forming wet products by means of a forming die; transferring the wet products from the forming die by means of a heated transferring die-and-heated pressing tool arrangement for in-mould pressing and drying of the wet product; and delivering the dried products to a down line facility.

A preferred embodiment of the invention well now be described by means of a non-limiting example only and with reference to the accompanying drawings.

BRIEF DESCRIPTION OF DRAWINGS

Please note that the same reference numerals are used to denote corresponding parts in the accompanying drawings.

MODES FOR CARRYING OUT THE INVENTION

Figure 1:
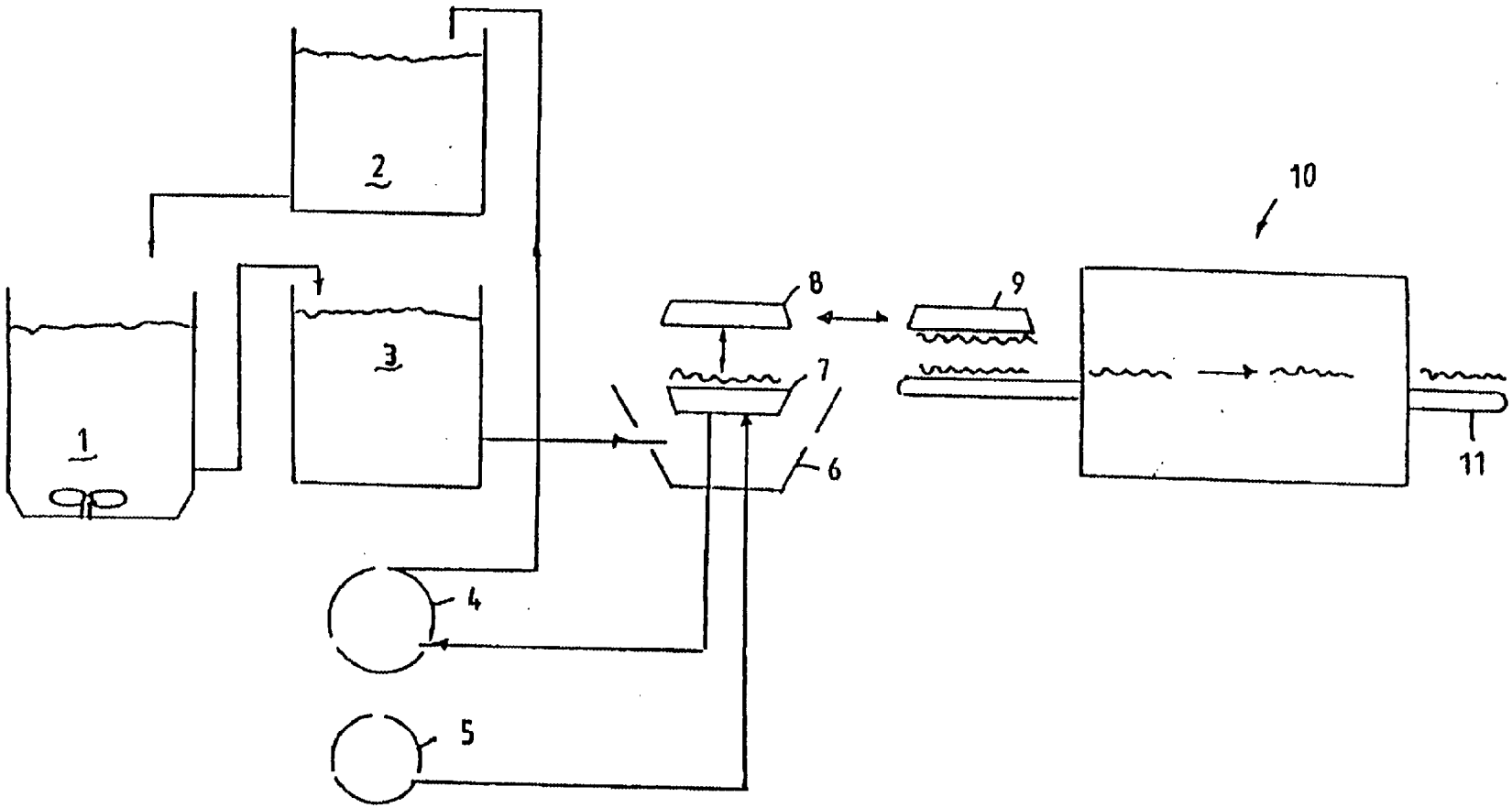
FIGURE 1 PRIOR ART
FIG. 1 is a diagrammatic layout of a traditional pulp moulding process.

A traditional pulp moulding process as illustrated in FIG. 1 typically includes a pulper (1) in which weighed raw materials such as waste paper is loaded together with processed water from a white water feed tank (2) in the required dry fibre-to-water ratio and pulped. Once the required pulp is obtained, it is pumped to a stock container (3) from where it is fed on demand to a moulder (6).

The moulder (6) includes a set of forming dies (7), consisting of perforated bases over which fine mesh is fitted. During the process, vacuum is applied to the forming dies (7) or moulds while they are submerged in the pulp. During this forming process, water in the solution is drawn through the mesh, leaving behind matted fibres in the shape of the product as formed by the forming dies (7). The forming dies (7) are then removed from the pulp and engaged with transfer dies (8) or moulds. Vacuum is then applied to the transfer dies (8) while positive pressure is simultaneously applied to the forming dies (7) to transfer the product from the forming dies to the transfer dies.

The transfer dies (8) are then removed to a position (9) in which the vacuum is removed and positive pressure is applied so as to eject the wet products therefrom. A conveyor belt (11) then transfers the wet products through a dryer (10) in which the wet products are subjected to high velocity, high temperature air flow.

Once the dried products leave the dryer (10), they are stacked and/or stored manually or automatically as required. At this stage, the final product finish is coarse and dimensional accuracy is poor as well as product deformation exists, primarily due to the application of high velocity, high temperature air flow on the wet products during the drying process. A secondary process or so-called "after pressing" process is often incorporated, during which products are placed between two precisely machined heated moulds which are brought together under pressure for a short period during which the product is ironed into shape (not shown) so as to improve product quality.

In an effort to overcome the disadvantages of poor surface finish, dimensional inaccuracy and deformation, an in-mould drying or so-called "thermo-form" process was developed.

Figure 2:
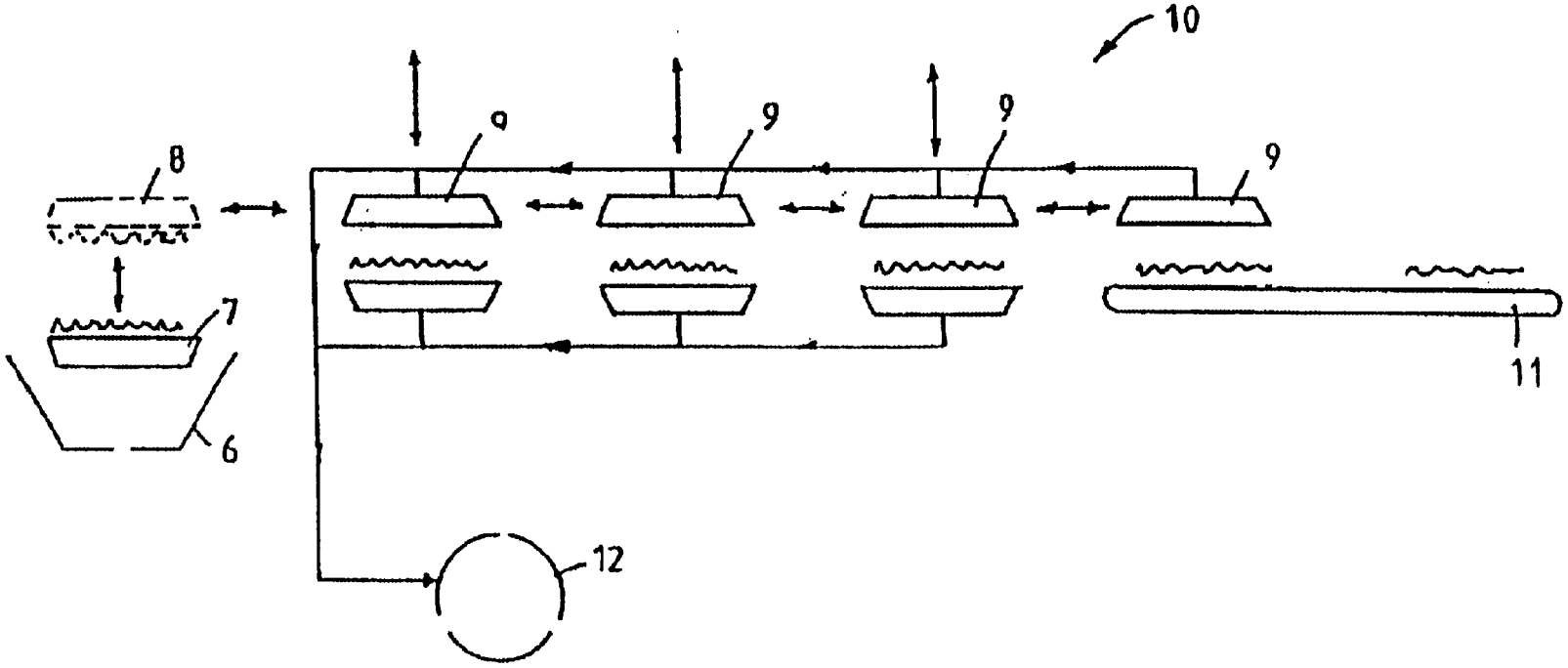
FIGURE 2 PRIOR ART
FIG. 2 is a diagrammatic layout of an existing in-mould drying or so-called "thermoformed" pulp moulding process.

The in-mould drying process with reference to FIG. 2 substituted the steps of conveyor drying with an in-mould drying step wherein the wet product, once the forming die (7) is removed from the moulder (6), is transferred by means of the transfer die (8) to a series of pressing stations (10), each pressing station having a set of heated, opposed, closable pressing tools (9) with means for scavenging steam resulting from heating under vacuum from the wet product. Once the product has been dried to the required degree, the dried product is ejected onto a conveyor (11) for transfer to down line facilities.

The process typically includes a facility (12) for fooling the steam scavenged under vacuum from the wet products (9).

Figure 3:
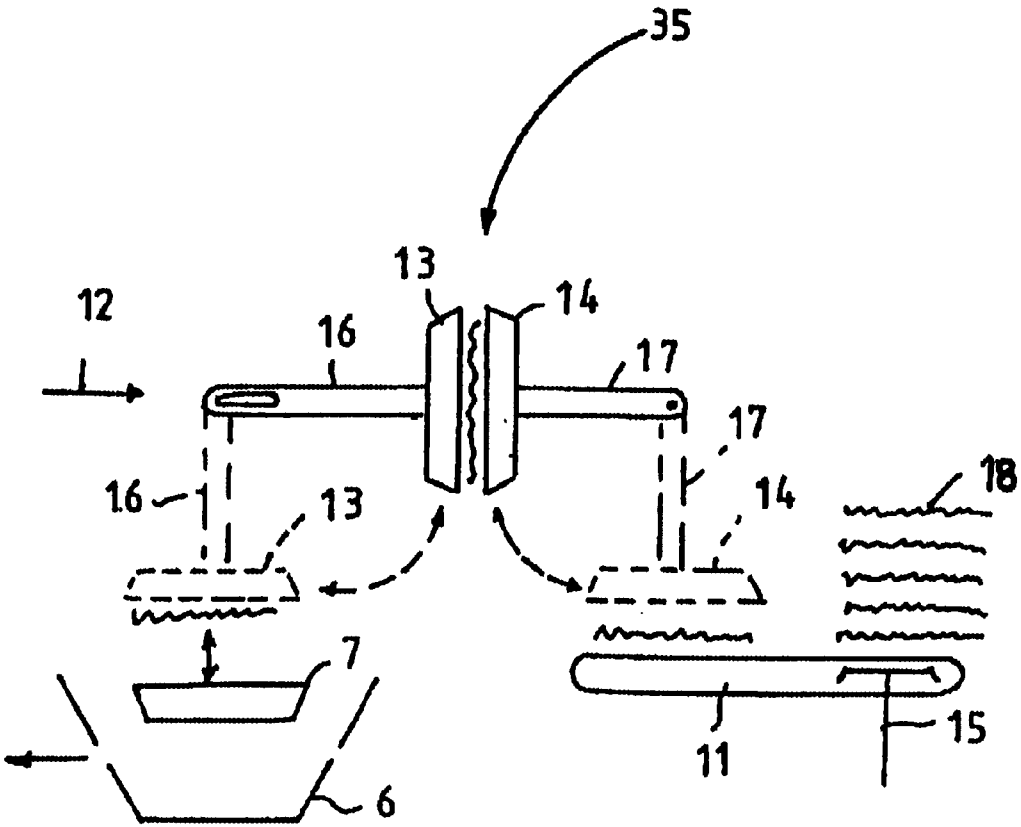
FIG. 3 is a diagrammatic layout of part of an in-mould drying, pulp moulding process in accordance with the invention.

An in-mould drying, pulp moulding process in accordance with the invention and partially as illustrated in FIG. 3 includes the steps of preparing pulp stock in a pulper (not shown); forming wet products by means of forming dies (7) in a moulder (6); transferring the wet products from the forming dies by means of a heated transferring die-and-heated pressing tool arrangement generally indicated by the number 35, comprising a first die element (13) and a second die element (14), having a mould cavity therebetween, for in-mould pressing and drying of the wet products; and delivering the dried products to a conveyor belt (11) for conveyance to a storage facility (18) where the dried products are stacked by means of an automatic stacker (15).

As in the traditional type moulding process (FIG. 1) and the existing in-mould drying, pulp moulding process (FIG. 2), the in-mould drying, pulp moulding process in accordance with the invention utilizes negative and positive air pressures to retain the products in the respective dies (7), (13) and (14) and to eject the products from the dies and/or pressing moulds (14) when required.

The in-mould drying equipment in the form of the first die element (13) and the second die element (14) of the heated transfer die-and-heated pressing tool arrangement is rotatable so as to enable the transfer and press drying of the wet products from the forming die (7) to the conveyor (11) as dry products.

Figure 4:
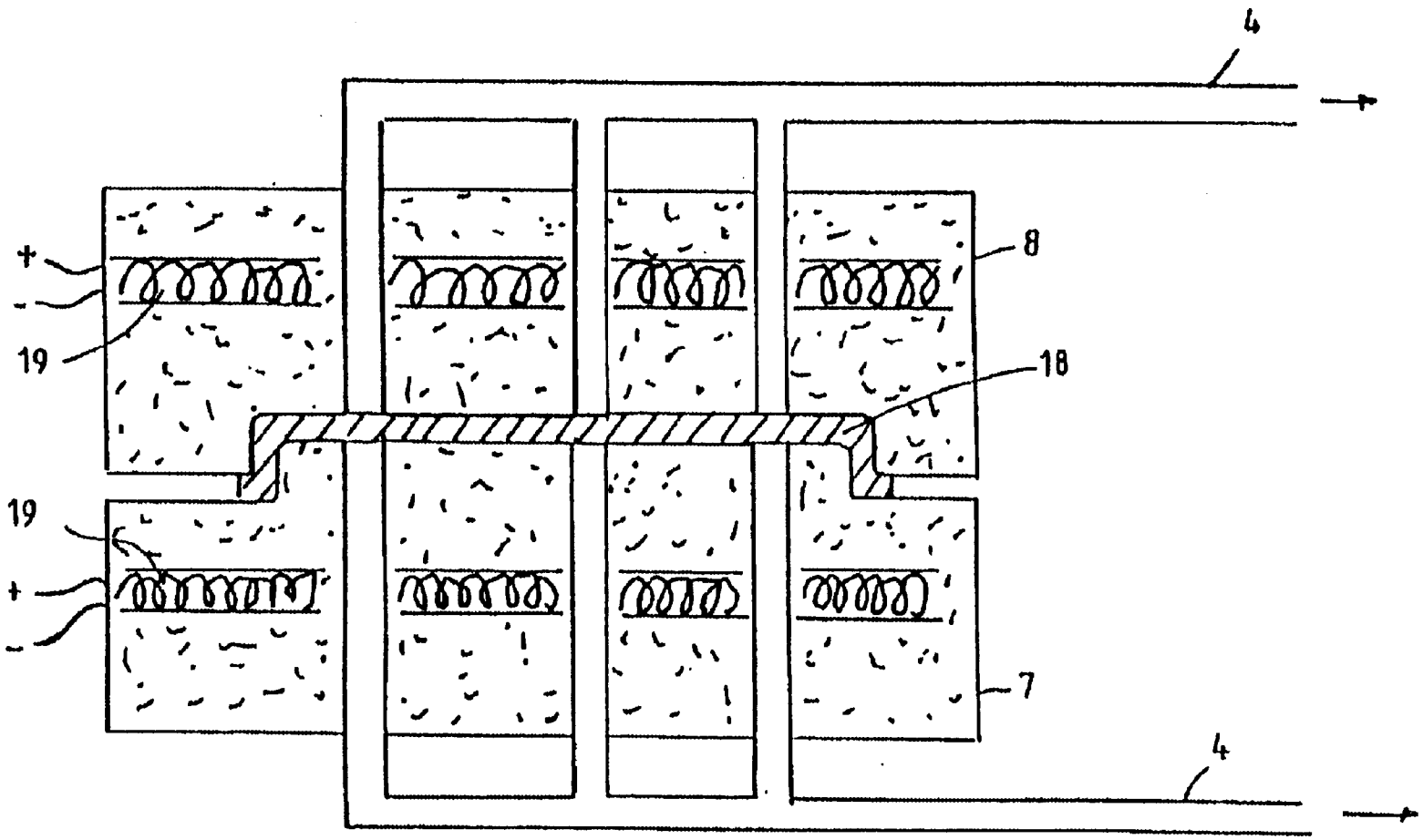
FIG. 4 is a cross-section side view of existing in-mould drying equipment.

The first die element (13) and the second die element (14) are operatively associated mechanically with each other so as to provide a heated mechanical press therebetween, thus defining the heated transfer die-and-heated pressing tool arrangement therewith. Existing in-mould drying equipment as illustrated in FIG. 4 comprises a mould, having a male part (7) and a complementary female part (8), each part being heated electrically by means of electric elements (19) so as to ensure the drying of an in-mould wet product (18). Male and female parts (7) and (8) are provided with air passages for scavenging steam generated during the drying process from the wet product (18) under vacuum.

Further in-mould drying equipment is disclosed in European Patent Application No. EPO 728 868 A2 in the name of Sintokogio Ltd. Comprising a pair of dies, each die being made up of a moulding member and a chamber forming member, forming between them a chamber, into which hot air is supplied. The moulding member includes a plurality of air-vent through-bores transmitting the hot air to the in-mould wet product.

Figure 5:
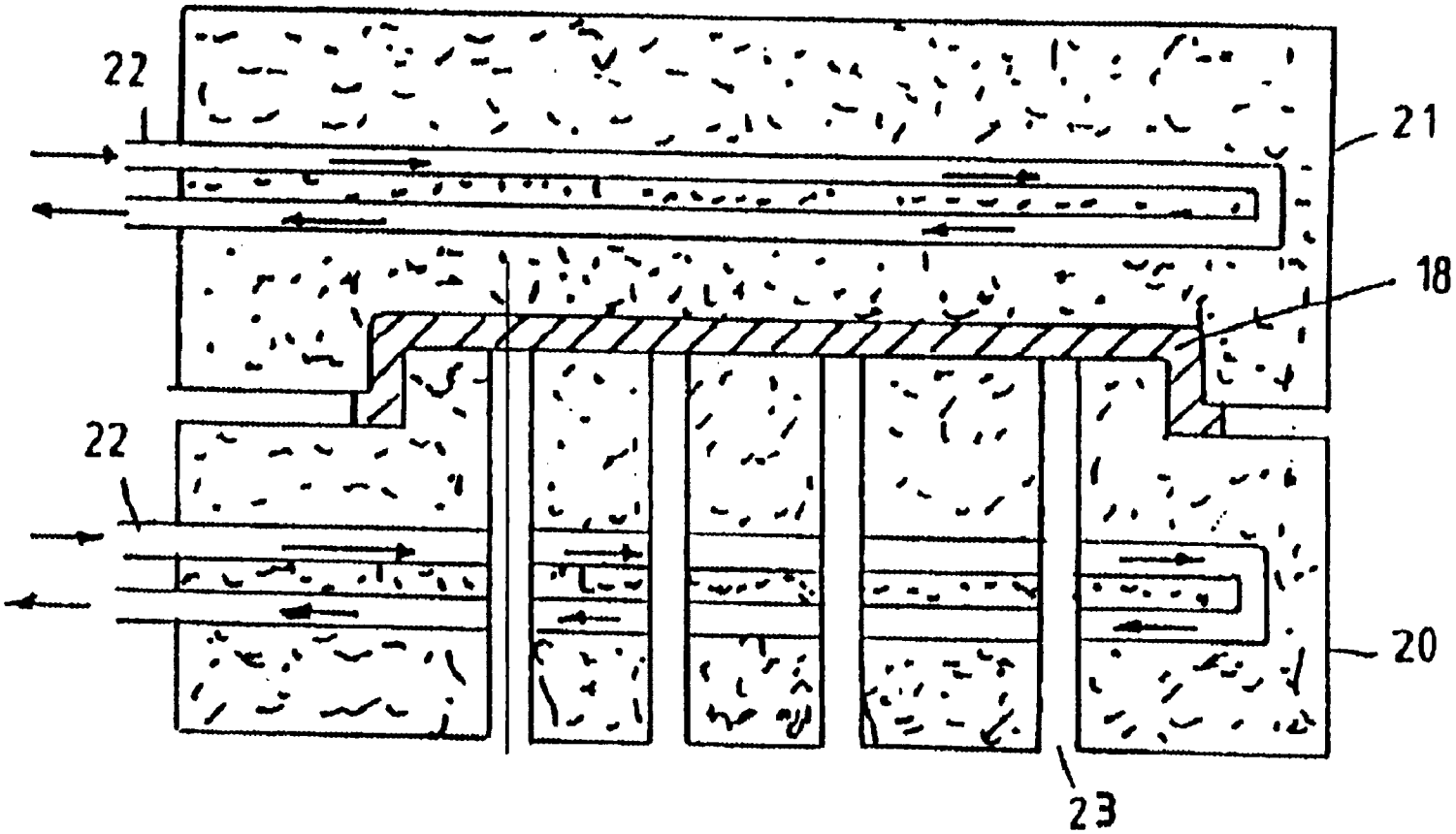
FIG. 5 is a cross-section side-view of in-mould drying equipment in accordance with the invention.

In-mould drying equipment in accordance with the invention and as illustrated in FIG. 5 comprises a male part (20) and a female part (21), each part being provided with a fluid passage (22) for receiving a heated fluid therethrough for the drying of the in-mould wet product (18).

The male part (20) is further provided with a set of vents (23) so as to allow steam generated during the in-mould drying step to escape from the wet product (18) therethrough to the atmosphere. Alternatively, the steam generated may be scavenged under vacuum.

Figure 6:
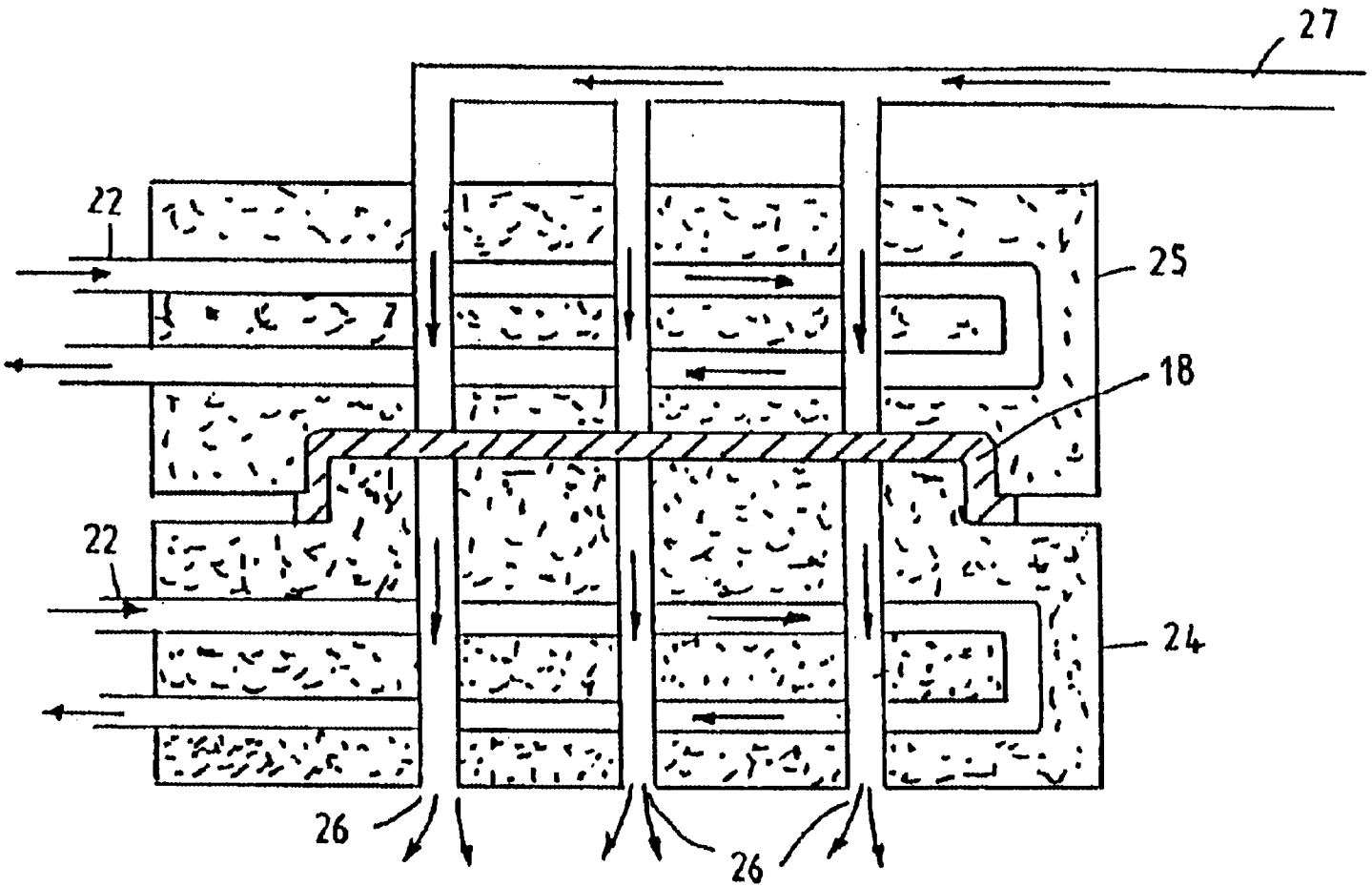
FIG. 6 is a cross-sectional side view of an alternative design of in-mould drying equipment in accordance with the invention.

Alternatively designed in-mould drying equipment in accordance with the invention and as illustrated in FIG. 6 comprises a male part (24) and a female part (25), corresponding with the elements (13) and (14) respectively, each part being provided with a primary fluid passage (22) for receiving heating fluid therethrough so as to dry the in-mould wet product (18) therebetween.

Figure 7:
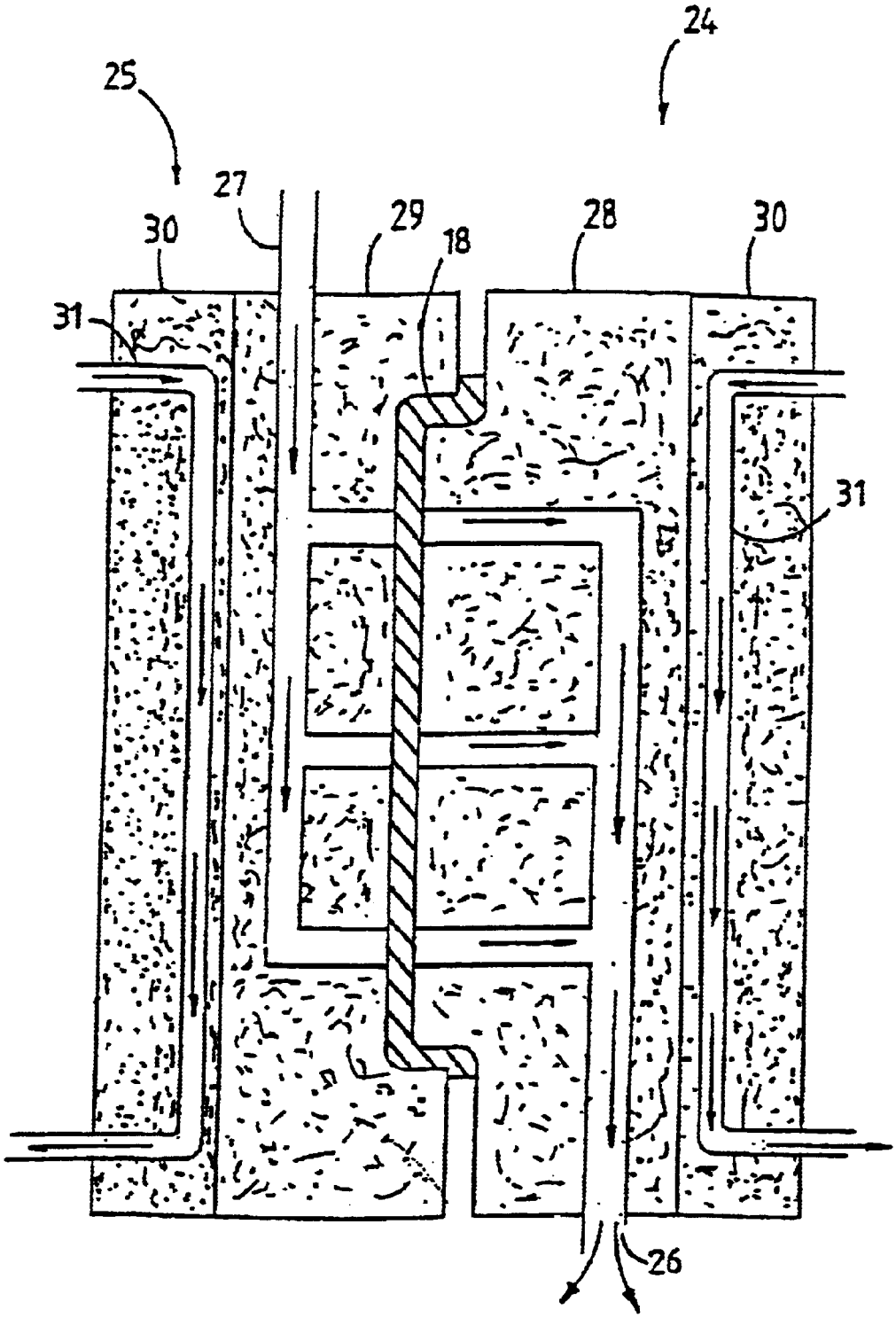
FIG. 7 is a cross-sectional side view of a second alternative design of in-mould drying equipment in accordance with the invention.

In a second, and preferred, alternative design for in-mould drying equipment, as illustrated in FIG. 7, both the male part (24) and the female part (25) comprise a die element (28) and (29) respectively, mounted to a plate (30) including a plenum chamber (31) incorporating the primary fluid passage. The heated transfer die-and-pressing tool arrangement is configured so as to allow the in-mould pressing and drying step to take place with the plate (30) being orientated substantially vertically.

The male part (24) is further provided with a set of secondary fluid passages (27) and the female part (25) is further provided with a set of vents (26), the set of secondary fluid passages and the set of vents being staggered relative to each other so as to communicate gaseously to allow the introduction of pressurized gas to the wet product through the secondary fluid passages and the venting of the gas together with the steam generated during the in-mould drying step in a singular direction through the wet product (18) via the vents to the atmosphere, while enhancing the substantially uniform flow of the pressurized gas through the wet product. Alternatively, the steam may be scavenged under vacuum.

The in-mould drying, pulp moulding process and related system in accordance with the invention thus provide a pulp moulded product with relatively good quality finish and high dimensional accuracy without deformation in a more energy efficient process in a relatively small area, requiring relatively less manpower and relatively less tooling.

It will be appreciated that may variations in detail are possible without departing from the scope and/or spirit of the invention as claimed in the claims hereafter.

What is claimed is:

1. A pulp moulding process including the steps of (A) preparing pulp stock;

(B) forming wet pulp products by means of a forming die; and (C) delivering the pulp products to a down-line facility;

wherein the wet pulp products are transferred from the forming die by means of a first die element of aheated transferring die-and-pressing tool arrangement, wherein the heated transferring die-and-pressing tool arrangement comprises the first die element and a second die element, having a mould cavity therebetween, wherein the wet pulp products are simultaneously pressed and dried in the heated transferring die-and-pressing tool arrangement, and transferred to the down-line facility by the second die element as pressed, dried pulp products.

2. The pulp moulding process according to claim 1, including the step of using a heated fluid medium for providing heat in the pressing and drying step.

3. The pulp moulding process according to claim 2, wherein the heated fluid medium is steam.

4. The pulp moulding process according to claim 2, wherein the heated fluid medium is thermal oil.

5. The pulp moulding process according to claim 4, wherein the thermal oil is maintained at a negative gauge pressure.

6. A tool arrangement for use in a pulp moulding process comprising a male part and a female part, at least one part being provided with a primary fluid passage for receiving a heating fluid therethrough and at least one part being provided with at least one vent so as to allow steam generated during an in-mould pressing and drying step to escape therethrough, wherein the tool arrangement is characterized in being provided with at least one secondary fluid passage for receiving pressurized gas, such as air, therethrough, the secondary fluid passage being orientated so as to communicate gaseously with the vent to force the pressurized gas and the steam generated during the in-mould drying step in one direction through the in-mould wet product.

7. The heated transfer die-and-pressing tool arrangement as claimed in claim 6, characterized by being provided with a set of secondary fluid passages and a set of vents, the set of secondary fluid passages and the set of vents being staggered relative to each other so as to enhance the substantially uniform flow of pressurized gas through the wet product.

8. A tool arrangement for use in a pulp moulding process comprising a male part and a female part, at least one part being provided with a primary fluid passage for receiving a heating fluid therethrough and at least one part being provided with at least one vent so as to allow steam generated during an in-mould pressing and drying step to escape therethrough, wherein at least one of the male part and female part comprises a die element mounted on a plate, having a plenum chamber incorporating the primary fluid passage, and wherein the tool arrangement is characterized in being provided with at least one secondary fluid passage for receiving pressurized gas, such as air, therethrough, the secondary fluid passage being oriented so as to communicate gaseously with the vent to force the pressurized gas and the steam generated during the in-mould drying step in one direction through the in-mould wet product.

9. The heated transfer die-and-pressing tool arrangement as claimed in claim 8, characterized by being provided with a set of secondary fluid passages and a set of vents, the set of secondary fluid passages and the set of vents being staggered relative to each other so as to enhance the substantially uniform flow of pressurized gas through the wet product.

10. A tool arrangement for use in a pulp moulding process comprising a male part and a female part, at least one part being provided with a primary fluid passage for receiving a heating fluid therethrough and at least one part being provided with at least one vent so as to allow steam generated during an in-mould pressing and drying step to escape therethrough, wherein the tool arrangement is characterized by being provided with a set of secondary fluid passages and a set of vents, the set of secondary fluid passages and the set of vents being staggered relative to each other so as to enhance the substantially uniform flow of pressurized gas through the wet product.

11. A tool arrangement for use in a pulp moulding process comprising a male part and a female part, at least one part being provided with a primary fluid passage for receiving a heating fluid therethrough and at least one part being provided with at least one vent so as to allow steam generated during an in-mould pressing and drying step to escape therethrough, wherein at least one of the male part and female part comprises a die element mounted on a plate, having a plenum chamber incorporating the primary fluid passage, and wherein the tool arrangement is characterized by being provided with a set of secondary fluid passages and a set of vents, the set of secondary fluid passages and the set of vents being staggered relative to each other so as to enhance the substantially uniform flow of pressurized gas through the wet product.

12. A tool arrangement for use in a pulp moulding process comprising a male part and a female part, at least one part being provided with a primary fluid passage for receiving a heating fluid therethrough and at least one part being provided with at least one vent so as to allow steam generated during an in-mould pressing and drying step to escape therethrough, wherein the tool arrangement is characterized by the heated transfer die-and-pressing tool arrangement being rotary so as to enable rotary transfer and drying of a wet product between a forming die and a down line facility.

* * * * *